US006569039B1

(12) United States Patent
Cope

(10) Patent No.: US 6,569,039 B1
(45) Date of Patent: May 27, 2003

(54) GOLF BALL POSITION MARKER ASSEMBLY

(76) Inventor: Jeffrey L. Cope, 423 Goldfinch Dr., Augusta, GA (US) 30907

( * ) Notice: Subject to any disclaimer, the term of this patent is extended or adjusted under 35 U.S.C. 154(b) by 0 days.

(21) Appl. No.: 09/834,871

(22) Filed: Apr. 12, 2001

Related U.S. Application Data

(63) Continuation-in-part of application No. 09/552,388, filed on Apr. 19, 2000, now abandoned, and a continuation-in-part of application No. 09/409,325, filed on Sep. 30, 1999, now abandoned.

(60) Provisional application No. 60/130,246, filed on Apr. 19, 1999, and provisional application No. 60/102,617, filed on Oct. 1, 1998.

(51) Int. Cl.[7] ..... A63B 57/00

(52) U.S. Cl. ..... 473/406

(58) Field of Search ..... 473/406, 408; 224/918; D21/793, 794

(56) References Cited

U.S. PATENT DOCUMENTS

| | | | | |
|---|---|---|---|---|
| 3,136,547 A | | 6/1964 | Schaper | |
| 3,139,690 A | | 7/1964 | Hait | |
| 3,208,123 A | | 9/1965 | Koos | |
| 3,233,802 A | | 2/1966 | Ludwick | |
| 3,298,579 A | * | 1/1967 | Smith | 224/918 |
| 3,339,300 A | | 9/1967 | Bury | |
| 3,620,426 A | | 11/1971 | Hatch | |
| 4,007,928 A | | 2/1977 | Doubt | |
| 4,475,676 A | | 10/1984 | Smith | |
| 4,530,500 A | | 7/1985 | Kaymen | |
| 5,135,220 A | | 8/1992 | Baldoni | |
| 5,160,134 A | | 11/1992 | McDonald | |
| 5,282,616 A | | 2/1994 | Stacavich-Notaro | |
| 5,295,683 A | * | 3/1994 | Tate | 224/918 |
| 5,305,999 A | * | 4/1994 | Tate | 473/406 |
| 5,569,103 A | | 10/1996 | Sihn | |
| 5,788,197 A | * | 8/1998 | Tutela | 224/918 |
| 5,795,248 A | * | 8/1998 | Giglio | 473/406 |
| 6,033,322 A | * | 3/2000 | England | 473/406 |
| 6,142,348 A | * | 11/2000 | Park | 224/918 |

* cited by examiner

*Primary Examiner*—Steven Wong
(74) *Attorney, Agent, or Firm*—Bernstein & Associates, P.C.; Jason A. Bernstein

(57) ABSTRACT

A golf ball position marking assembly that includes a marker removably secured to a decorative or functional accessory item such as a ring, pendant, clip, belt, key ring, bracelet, buckle, divot tool, or the like. The marker is magnetically secured to a base in such a way that a golfer can quickly and easily detach it to mark the position of a golf ball, and as easily re-attach it when the time comes to play. The assembly is made of any suitable material, including plastics, metals, ceramics, and composites. If desired, it can include decorative or functional indicia such as precious stones, decorative etching or enameled ornamentation, the user's name or initials, memorable dates, advertising material, tournament logos, or golf club logos.

3 Claims, 3 Drawing Sheets

GOLF BALL POSITION MARKER ASSEMBLY

CROSS REFERENCE TO RELATED APPLICATIONS

This application is a continuation-in-part of Ser. No. 09/552,388 Apr. 19, 2000 abandoned, and is a continuation-in-part of Ser. No. 09/409,325 Sep. 30, 1999 abandoned, which claims benefit of No. 60/102,617 Oct. 1, 1998 and claims benefit of No. 60/130,246 Apr. 19, 1999.

BACKGROUND OF THE INVENTION

1. Field of the Invention

The present invention relates to a golf ball position marker assembly that includes a wearable or nonwearable accessory item such as a ring, pin, belt buckle, golf bag or glove, key ring, divot tool, clip, or the like. In particular, the present invention relates to a golf ball position marker assembly wherein a ball marker is quickly and easily attached to an accessory item, and as quickly removed therefrom for use.

2. Discussion of Background

During a golf game, a golfer must sometimes move his or her ball aside to permit another golfer to putt. On these occasions, the golfer who moves a ball places a marker on the green to identify the original position of the ball so that it can be replaced in the same spot. Many golfers use whatever small items they happen to have available as ball markers, including coins, buttons, and the like, others prefer special marking devices that can be stored with other golf equipment or attached to their clothing. For purposes of this specification, the terms "golf ball position marker," "position marker," "ball marker," "marker" and the like are used interchangeably to refer to any device used to mark the position of a golf ball. Typical markers are generally flat, disc-like objects; some have posts that project a short distance into the soil when the marker is in use.

Many different types of golf ball markers are available, some of which are combined with other tools useful to golfers (clocks, compasses, wind indicators, divot repair tools, and so forth). Several devices include permanent magnets for securing a marker when it is not in use. For example, Balloon's golf ball position marker apparatus consists of a ferrous metallic disc mounted to a magnetized housing, which in turn is mounted to a wrist strap, spring clip, or post mount (U.S. Pat. No. 5,135,220). The housing may also include a wind indicator.

Cayman discloses a golf ball position marker and storage device that can be worn on a waistband (U.S. Pat. No. 4,530,500). This device includes a plastic or metal clip, a magnet with an outwardly-projecting knob affixed to the front of the clip, and a removable, magnetized marker with a central throughhole that fits over the knob for storage when not in use. The marker is larger than the magnet, thus, the user can easily grasp the edges of the marker to pull it away from the magnet.

Ludwick shows a combined golf ball position marker and carrier which includes a belt clip (U.S. Pat. No. 3,233,802). The carrier is molded of high-density polyethylene or polystyrene and has two recessed areas in the front, each recess containing a magnet and partially surrounded by a shallow rim. The recesses hold markers made of a magnetic material such as zinc iron alloy. In U.S. Pat. No. 3,208,123), Koos discloses a belt buckle with a magnetic element for holding a golf ball marker. The buckle may also have ornamental features such as crossed golf clubs that are provided for aesthetic appeal.

Hait's golfing aid consists of a pin with a magnet for holding a marking device. The marking device itself is preferably a stainless steel disc which can be engraved with the owner's initials or some other decorative features (U.S. Pat. No. 3,139,690). Schaper discloses a belt buckle with a recess for a permanent magnet that secures a marker in position (U.S. Pat. No. 3,136,547). The marker itself is formed with a peripheral flange that helps prevent it from slipping off the face of the magnet.

Fazekas provides a multi-purpose golf tool with a recess for holding a ball marker (U.S. Pat. No. 5,733,208). A raised magnetic post in the center of the recess holds the marker in position. By pushing down on one edge of the marker, the user tilts and lifts the marker up over the edge of the recess to slide it forward into position. Suzuki's golf ball position mark assembly includes a permanent magnet; the marker has a projection to assist the user in removing it for use, and also to fix it on the ground (U.S. Pat. No. 3,923,215).

Devices with storage for two markers are also known. Tate shows such a device, which has two separate magnet-containing recesses for two equally-sized markers (U.S. Pat. No. 5,305,999). The magnets occupy less than the entire peripheral areas of their respective recesses, thus, pressing the edge of a marker tilts the opposing edge out of its recess. The marker may have a central post that fits into a corresponding aperture in the magnet (U.S. Pat. No. 5,295,683). Buckman's device has two magnet-containing recesses on opposing sides of a ground repair tool (U.S. Pat. No. 4,315,624).

Markers have been attached to golf equipment such as putters. For example, Bayer's putter has includes magnets, a recess dimensioned for holding a marker made of magnetized material, and an opening in the bottom surface that is slightly smaller than the diameter of a golf ball (U.S. Pat. No. 5,417,426). When a ball enters the opening, it trips the marker from the magnet, causing the marker to fall out and mark the position of the ball. Kepler shows a tournament-type putter with a marker and a ball retrieval-retainer structure that allows the user to pick up balls without bending over (U.S. Pat. No. 4,248,430).

Another type of device has holes or slots dimensioned for receiving the post of a marker. For example, McDonald's combined golf green repair tool and timepiece includes peripheral holes for attaching items such as a keychain and ball marker (U.S. Pat. No. 5,160,134). The back of the timepiece is attached to the central portion of the tool, above the tines; the marker is inserted into one of the peripheral holes. Smith provides a golf marker and tee caddy consisting of an S-shaped clip with slots for holding markers and tongues for holding golf tees (U.S. Pat. No. 4,475,676). This device can be clipped onto a golf bag or the user's clothing (lapel, waistband, etc.)

Markers can be combined with divot tools or other devices useful to golfers, as shown by Tate (U.S. Pat. No. 5,295,683). Here, a divot tool is formed with a shallow, concave ball marker seat that contains a disk of magnetic material having a central opening. A ball marker can be removably seated on top of the magnetic material, with the marker post (if present) extending through the opening.

Doubt (U.S. Pat. No. 4,007,928) shows a golfer's combination tool which can be used as a shoe horn, divot repair device, and a prop for a golf club when the user wishes to keep the handle away from the ground. The device includes a small center hole into which the user can insert a standard golf ball marker. Hatch (U.S. Pat. No. 3,620,426) discloses a combination golf green repair tool and ball marker with a carrier. His device consists of a flat body member with a handle at one end and prongs at the other end, a hole for inserting a marker, and a carrier with a spring clip that can be attached to a pocket or belt. The stem of the marker may be mounted via a rubber grommet. Bury's detachable mountable pendent has a horseshoe-shaped clamp designed for holding tokens, cards, discs, etc. as well as golf ball markers (U.S. Pat. No. 3,339,300). The inside edge of the clamp is formed with a groove into which the user can slide a disc-shaped object such as a marker. The device can be attached to the user's clothing with a clip.

Position markers can be attached to jewelry items such as tie tacks and bracelets. For example, Balloon's magnetic marker (described above) can be attached to a post mount. Stacavich-Notaro's golf ball marker, described in U.S. Pat. No. 5,282,616, has a hook-and-loop material (VELCRO or the like) on the bottom surface so that the marker can be attached to a disk that has a top surface covered with a mating hook-and-loop material. The device can be attached to a golf club shaft or a tie tack. Furin (U.S. Pat. D252,289) shows a golf ball marker band in the form of a bracelet.

Sihn's golf ball marker carries a variety of decorative elements such as gems, engraved initials, etc. (U.S. Pat. No. 5,569,103). The bottom of the marker includes a rounded stud that allows the user to secure the marker to a golf glove, lapel button hole or the like; the stud also helps secure the marker in position on a green.

My co-pending provisional application Ser. No. 60/130,246, filed Apr. 19, 1999 (the disclosure of which is incorporated herein by reference), shows a device wherein at least one position marker is magnetically attached to the accessory item in such a way that a golfer can quickly and easily slide it from the item to mark the position of a golf ball, and as easily re-attach it to the item when the time comes to play the ball and move on. The magnets are positioned so that a golfer can operate the device with one hand: to dislodge a marker from the device, he simply taps the device against a convenient object (or releases it with his thumbnail), then slides it off and positions it on the green.

Golf ball position markers are preferably quite small in size (generally no larger than a quarter), light in weight, easy to carry, and easy to handle. Due to their small size, markers are easy to overlook and therefore easy to lose. Thus, a useful marker should be readily visible when placed on a green. Visibility is also desirable since stepping on or walking across the line of another golfer's putt to the hole is considered to be a breech of etiquette. Despite the wide variety of markers that are available to golfers, there is a continuing need for a practical, aesthetically pleasing position marking device that is easy to attach to—and equally easy to remove from—a decorative or functional accessory such as a ring, tie tack, bracelet, key holder, belt buckle, divot tool, clip, or the like.

SUMMARY OF THE INVENTION

According to its major aspects and broadly stated, the present invention is a golf ball position marking assembly that carries at least one golf ball position marker removably secured to a fastener carried by an accessory item. The ball marker is magnetically attached to the accessory item in such a way that a golfer can quickly and easily detach and use it to mark the position of a golf ball, and as easily retrieve and re-attach it when the time comes to play the ball.

An important feature of the present invention is the fastener which secures the marker to the accessory item. The fastener may be a magnetized seat for holding markers made of magnetized metal, and may also include a throughhole for securing post-type markers or removing disk-type markers. Alternatively, the fastener is a metal seat that secures a removable magnet which holds the marker.

Another important feature of the present invention is the accessory item, which can be any selected decorative or functional article including but not limited to a clip, pendant, bracelet, pin, watchband, ring, hatband ornament, belt buckle or money clip, divot repair tool, or key ring. While the invention is envisioned as being used primarily with wearable items and items that can be attached to clothing (shirts, jackets, trousers or skirts, golf gloves and golf shoes, belts and belt loops, jewelry, hatbands, etc.), it may also be used with non-wearable articles such as golf bags, golf clubs, tote bags, golf carts, and so forth.

Another feature of the present invention is its versatility. Not only can a golf ball position marking assembly according to the invention include a wide range of wearable and nonwearable accessory items, but the components of the assembly can be made of virtually any desired material. By way of example, a pendant or charm formed for carrying the ball marker can be made of base or precious metals, ceramics, composite materials, or durable plastics such as LUCITE and PLEXIGLAS. A marker used with the invention can itself can be made of gold, silver, or other metal, or take the form of a favorite coin, golf club token, or other suitably-dimensioned item. The marking assembly (or markers used therewith) can include decorative or functional indicia such as precious or semiprecious stones, decorative etchings or enameled ornamentation, small coins, the user's name or initials, memorable dates, tournament logos, or golf club logos. When decorated with club or tournament logos, the invention is a collectible item such as the special logo balls that are prized by many golfers.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1A:
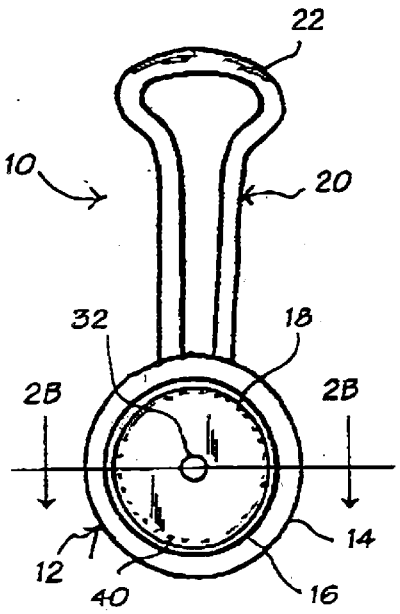
FIGS. 1A and 1B are front and back views, respectively, of a golf ball position marker assembly according to a preferred embodiment of the present invention.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. §112. As used herein, the terms "horizontal," "vertical," "left," "right," "up," "down," as well as adjectival and adverbial derivatives thereof, refer to the relative orientation of the illustrated structure as the particular drawing figure faces the reader.

Figure 1B:
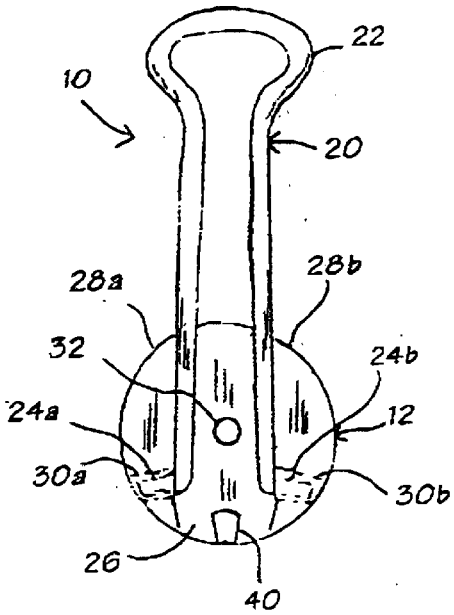
Figure 1C:
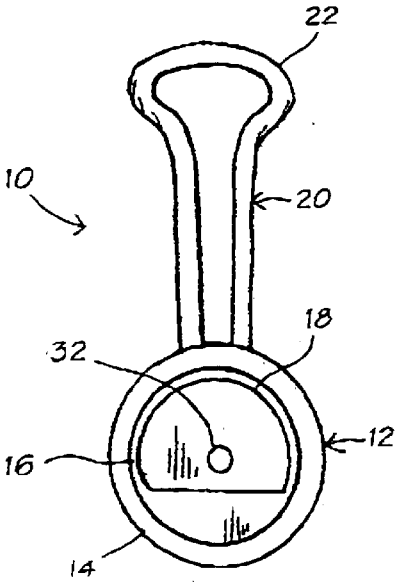
FIG. 1C is a front view of the assembly of FIG. 1A, showing an alternative magnetic insert.

Referring now to FIGS. 1A–C, there is shown a golf ball position marker assembly 10 according to a preferred embodiment of the present invention. Assembly 10 includes a retainer for holding a ball marker, in the form of a body 12 with full or partial rim 14 about a recessed base 16 on the front side of body 12, a magnetized insert 18 at least partially covering base 16, and a generally U-shaped clip 20 with a loop 22 and outwardly-projecting end portions 24*a*, 24*b*. The back side of base 16 (FIG. 1B) has formed therein a recess 26 between sections 28*a*, 28*b*, with channels 30*a*, 30*b* for receiving ends 24*a*, 24*b* of clip 20, generally as shown. A central throughhole 32 may extend through insert 18 and base 16.

Figure 2A:
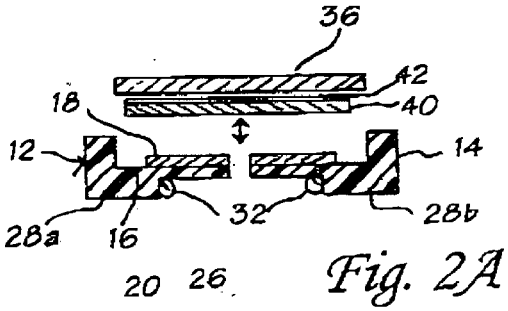
FIG. 2A is a cross-sectional view of the body of the assembly of FIG. 1A, taken along the lines 2B—2B of FIG. 1A.
Figure 2B:
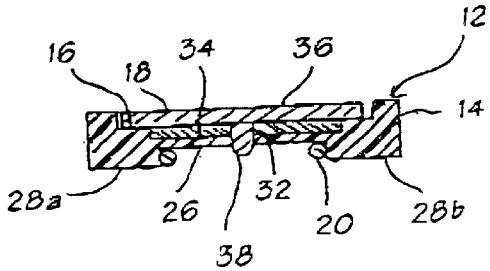
FIG. 2B shows the assembly of FIG. 2A with an alternative magnetic insert.

Insert 18 may be mounted to the surface of base 16 (FIG. 2A), or be placed in a suitably-dimensioned recess 34 (FIG. 2B). When installed on recessed base 16, a disc-shaped ball marker 36 is held securely in position by insert 18. Insert 18 may substantially cover base 16 as shown in FIG. 1A, or partially cover the base as shown in FIG. 1C. It has been found that assembly 10 is especially easy to manipulate when used with an insert 18 of this latter type, that is, an insert that is somewhat smaller than a typical ball marker. Insert 18, when present, is generally flat, disc-shaped, or ring-shaped. However, other configurations may also be useful for the practice of the invention.

As noted above, insert 18 at least partially covers base 16. Insert 18 may be approximately circular as shown in FIG. 1A, partial-circular as shown in FIG. 1C, or indeed any other desired shape. The optimum dimensions of insert 18 depend on the particular material selected for the insert and the size and weight of marker 36 to be used therewith. Thus, the optimum dimensions (width, thickness, overall shape) of insert 18 are best selected by a modest degree of experimentation in view of the materials used for manufacturing assembly 10.

Alternatively, insert 18 may be a nonmagnetized metal disc that holds a removable magnet 40 (FIGS. 1A and 2A). In this embodiment of the invention, insert 18 is a metal disc that at least partially covers base 16. Insert 18 may be press-fitted into a suitable recess in base 16, attached to the base by any suitable adhesive, or molded or assembled within the base. Magnet 40 can be of any size that fits base 16 and securely holds a ball marker. Magnetized or nonmagnetized inserts 18 can be used with any of the embodiment of the invention described herein, as may be preferred. Magnet 40 may be coated on one or both sides with TEFLON© or other suitable coating, for example, a coating 42 as shown in FIG. 2A. Coating 42 may be applied by painting, spraying, dipping, or other suitable technique. An assembly 10 that includes a throughhole 32 can be used with the type of ball marker having a post on one side. Preferably, throughhole 32 has a diameter such that, when assembly 10 is used with a post-type marker, the post fits snugly within the throughhole so that the ball marker can be securely held in position with an exposed end of a post 38 projecting somewhat beyond body 12 (FIG. 2B). These types of markers can be either magnetic or non-magnetic, thus, insert 18 may be optional for an assembly 10 used solely with post-type, nonmagnetic ball markers. However, insert 18 is present when assembly 10 is intended for use with metal disc-type ball markers such as marker 36 shown in FIG. 2A.

Clip 20 is preferably made of a somewhat springy or resilient material, allowing the user to remove the clip from body 12 simply by compressing ends 24*a*, 24*b* together and withdrawing the ends from channels 30*a*, 30*b*. In addition, clip 20 can be rotated by 180° if desired. Assembly 10 can be used as a paper clip, bookmark or the like; alternatively, assembly 10 can be clipped to a belt, waistband, or hatband, or worn as a pendant. If desired, assembly 10 may include a hook 40 FIG. 1B).

Figure 3A:
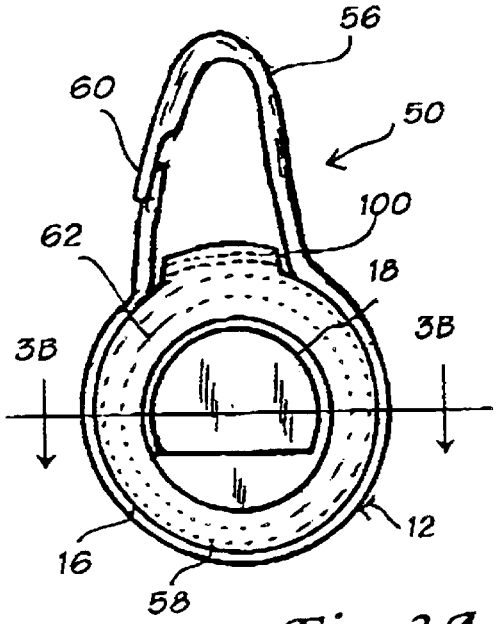
FIG. 3A is a front view of another golf ball position marker assembly according to a preferred embodiment of the present invention.
Figure 3B:
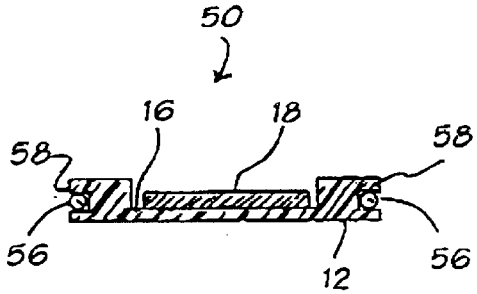
FIG. 3B is a cross-sectional view of the assembly of FIG. 3A, taken along the line 3B—3B of FIG. 3A.

Another golf ball position marker assembly 50 according to the invention includes a body 12 with a rim 14 about a base 16, a magnetized insert 18 of any convenient size and shape, and a clip 56 fitted in a generally circumferential channel 58 about the perimeter of body 12 (FIGS. 3A and 3B). Body 12 may include an optional enlarged portion 54 that serves as a stop for limiting rotation of body 12 on clip 56; portion 54 may carry decorative or functional indicia if desired. Portion 54 may include a throughhole 100 into which clip 65 or a chain (not shown) may be inserted.

Clip 56 may be fixed in position in channel 58; however, in a preferred embodiment of the invention, body 12 rotates freely on the clip, limited only by portion 54 (if present). Clip 56 is preferably a type of clip that can be readily opened and closed via a catch 60, such as the types of clips used to hold keys and the like. Like above-described clip 20, clip 56 is made of a somewhat springy, resilient material, preferably metal.

Assembly 50 may include a magnetized insert 18 that partially covers base 16 as shown in FIG. 3A; alternatively, an insert 18 such as that shown in FIG. 1A may be used if preferred. Insert 18 may include a throughhole 32 for use with post-type ball markers. Insert 18 may be mounted to the surface of base 16 as shown in FIG. 2A above, or in a recess such as recess 34 (FIG. 2B). If desired, a second recess 62 of any convenient diameter may be formed in the back of assembly 50. Second recess 62, if present, may be used for holding a second, post-type ball marker (not shown) while a first, disc-type ball marker is installed on insert 18. Above-described assembly 10 may also be fitted with a second recess 62 if desired.

Figure 3C:
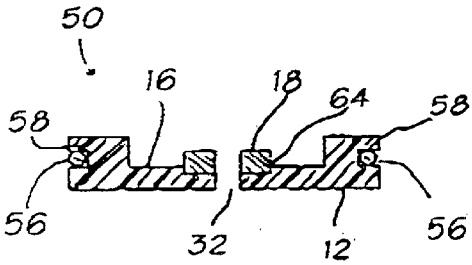
FIGS. 3C and 3D are cross-sectional views of additional embodiments of the golf ball position marker assembly of FIG. 3A.
Figure 3D:
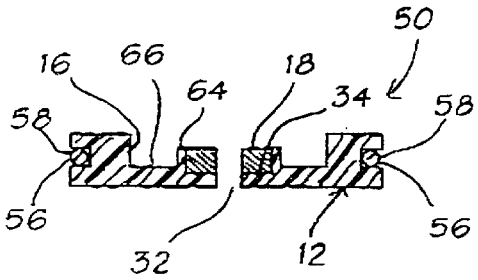

Additional configurations of insert 18 may also be useful. For example, insert 18 may be a somewhat smaller, ring-type magnet mounted in a recess 34 (FIG. 3C). Alternatively, recess 16 may include a raised shoulder 64 defining recess 34 and a second recess 66 (FIG. 3D). Insert 18 is placed in second recess 66, press-fitted in place or secured position by a suitable adhesive.

Figure 4:
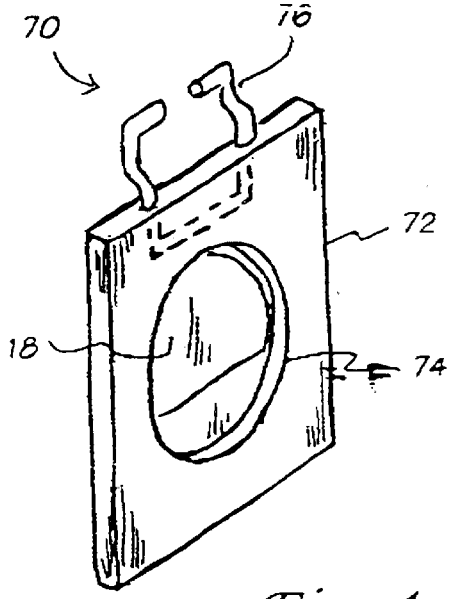
FIGS. 4 and 5 illustrate additional golf ball marker assemblies according to the present invention.
Figure 5:
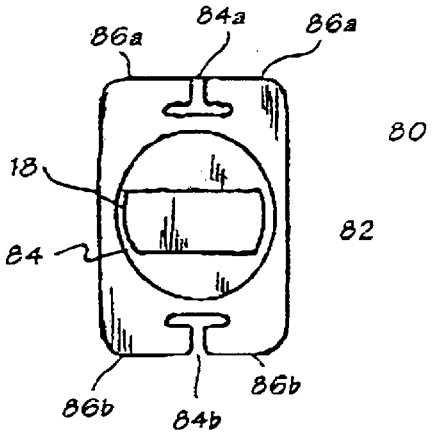

Additional golfball position marker assemblies 70 and 80 are shown in FIGS. 4 and 5, respectively. Assembly 70 has a body 72, a magnetic insert 18 in a recess 74, and a clip 76. Assembly 80 has a body 82 with a recess 84 that holds a magnetic insert 18, and a pair of approximately "T"-shaped cutouts 84*a*, 84*b* positioned on opposing sides of body 82. The resulting projections 86*a*, 86*b* allow the user to attach assembly 80 to a belt loop or the like. In addition, projections 86*a*, 86*b* can be used in the manner of divot repair tools.

Magnetic insert 18 may be secured to base 16 by an adhesive, or may simply be press-fitted into position into a suitably-dimensioned recess (such as recess 26, FIG. 2A). As noted above, the shape and dimensions of insert 18 may vary considerably within the scope of the invention. Thus, assemblies 70 and 80 may include any of the inserts 18 described above, and such others as may be evident to those of ordinary skill in the art. Magnetic insert 18 may cover substantially all of the surface of base 16, or a part thereof if preferred. Optionally, insert 18 may include a throughhole 32 for use with post-type ball markers.

Body 12 of assembly 10, and bodies 52, 72, 82 of assemblies 50, 70, 80, respectively, can be made of virtually any durable material, including metals, plastics (including clear plastics such as LUCITE and PLEXIGLAS), ceramics, and composite materials.

Figure 6:
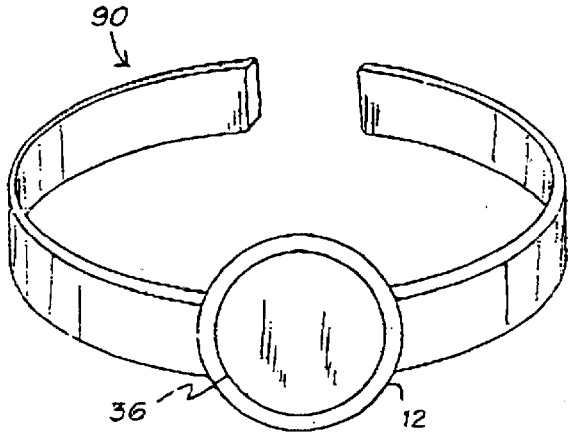
FIG. 6 is a perspective view of a bracelet according to the present invention.

A marking device according to the present invention can be used with other decorative and/or functional articles, including but not limited to accessories such as pendants, tie or collar pins, hat pins or hatband ornaments, belt buckles, bracelets, golf club shafts, binder clips, key rings, towel rings, divot tools, golf equipment, and so forth. For example, a bracelet 90, such as the bracelets favored by many athletes, may carry a ball marker 36 in a retainer such as body 12 (FIG. 6). Here, body 12 may be positioned anywhere convenient on bracelet 90, including the position shown in FIG. 6.

Figure 7:
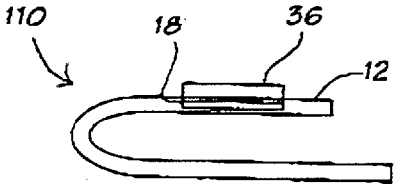
FIG. 7 is a side view of a belt clip according to the present invention.

In still another embodiment of the present invention, ball marker 36 can be secured to money clip such as 110 (FIG. 7). Clip 110 can be attached to wearable items such as a bracelet, wristband, hatband, waistband, or belt; alternatively, the clips can be used as money clips or be attached to a golf bag or golf cart. It will now be evident that an assembly according to the present invention may include a wide range of accessory articles in addition to those described above.

Figure 8:
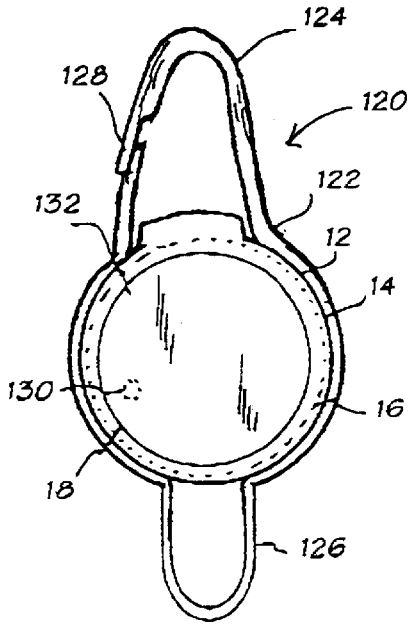
FIG. 8 is a front view of another marker assembly according to the invention.

Yet another embodiment of the present invention is shown in FIG. 8, which shows a golf ball position marker assembly 120 having a body 12 with a rim 14 about a base 16 (similar to above-described assembly 50), a magnetized or nonmagnetized insert 18, and a clip 122 fitted in a generally circumferential channel 58 about the perimeter of body 12. If desired, body 12 may include an optional enlarged portion 54 and a second recess 62 as described above. In a preferred embodiment, body 12 rotates freely on clip 122, limited only by portion 54 (if present).

Clip 122 has an upper portion 124 and a lower portion 126, generally as shown. One of portions 124, 126 may include a catch 128. Like clips 20 and 56, clip 122 is made of a somewhat springy, resilient material, preferably metal.

Body 12 in all embodiments of the invention may include a throughhole 130, a side slot 132, or both (FIG. 8). The user can remove a golf ball position marker from body 12 by inserting the tip end of a golf tee or other suitable object into throughhole 130 and pushing. If body 12 has a slot 132, the user can slide the marker from body 12 after removing clip 122, which serves as a retainer to hold the marker and body 12 together.

In use, assembly 120 may be carried in the user's pocket or may be attached to a golf bag, belt, or other accessory. Alternatively, assembly 120 can be used as a hanger for items such as towels, which can be inserted through one of portions 124, 126 while the other portion is hung on a hook, shower rod, or the like.

Figure 9:
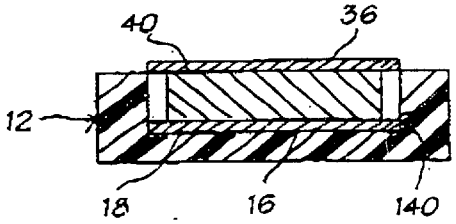
FIG. 9 is a cross-sectional view of another marker assembly according to the invention.

Still another embodiment of the invention is shown in Fig 9, wherein body 12 has a recess 140 fitted with a metal disk 18. A removable magnet 40 at least partially covers disk 18; ball marker 36 is secured by magnet 40. Insert 18 may be press-fitted into recess 140, attached to the base by any suitable adhesive, or molded or assembled within the base. Magnet 40 can be of any suitable size, and that securely holds a ball marker. As noted above, magnet 40 may be coated on one or both sides with TEFLON© or other suitable coating.

As will now be evident to those of ordinary skill in the art, the present invention contemplates a ball marker that can be removably secured to a variety of different decorative and/or functional articles. Other suitable articles for use with the invention include a binder clip, a key ring or towel ring, a padlock, and accessories such as a watch fob, a wristwatch, a pendant or charm, a belt slide, etc. If desired, a golf ball position marker assembly according to the invention may be equipped with other golfer's accessories such as divot repair tools and tee carriers.

In use, ball marker 36 is removed from assembly 10 (or other assembly according to the present invention) and placed in position on the putting surface of the green to mark the position of the user's ball. When it is time for the user to play, marker 36 is retrieved and re-attached to assembly 10, and the ball is placed on the green for play.

For some golfers, a golf ball position marker assembly according to the present invention may be a collectible item equivalent to golf logo balls and other golf-related collectibles. Many—perhaps most—people are collectors. Golfers in particular collect balls bearing the logos of famous golf clubs or golf courses, balls from courses they have played themselves, special-edition balls from tournaments, balls autographed by celebrities and champion golfers, and special balls such as those that have been used to play a hole-in-one.

The components of the invention can be made of virtually any convenient materials, including base and precious metals, ceramics, and durable plastics (LUCITE, PLEXIGLAS, and the like). The assembly may carry decorative or informational indicia such as precious stones, decorative designs, the user's name or initials, numbers, product brand names or trademarks, or golf club logos. It may include favorite jewels, coins, etc. that are removably installed in assembly 10 (or another assembly according to the invention) to serve as ball markers when so desired. Magnetized insert 18, when present, may be made of ferrous metal or other suitable materials, including rubber or plastic materials containing ferrous particles.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. A golf ball position marker disk holder assembly, comprising:

(a) a body having a front surface and a back surface, said front surface having a recess formed therein, said back surface having a first and second spaced apart channel formed thereon for removably holding a clip;

(b) a magnetic insert disposed in said recess, said insert attached to said body, said insert covering at least a portion of said recess for removably securing said ball marker disk thereto; and, (c) a clip for removable attachment to a belt loop or other object, said clip having an outwardly turned first end, an outwardly turned second end and a body section forming a loop and capable of flexion, said first and second ends being removably receivable within said first and second channels.

2. The assembly as recited in claim 1, further comprising a ball marker removably secured in said recess.

3. The assembly as recited in claim 1, wherein said body is made of a material selected from the group consisting of plastics, ceramics, and composites.

* * * * *